United States Patent [19]

Hellgren

[11] Patent Number: 4,711,111

[45] Date of Patent: Dec. 8, 1987

[54] FORMING PRESS MAT UTILIZES TRAYS FORMED OF THIN BOTTOM PLATES AND SEPARATE ANNULAR FRAMES

[75] Inventor: Keijo Hellgren, Västerås, Sweden

[73] Assignee: Asea AB, Västerås, Sweden

[21] Appl. No.: 868,432

[22] Filed: May 30, 1986

[30] Foreign Application Priority Data

Mar. 25, 1986 [SE] Sweden ..... 8601382

[51] Int. Cl.[4] ..... B21P 22/12

[52] U.S. Cl. ..... 72/63; 72/446; 72/455; 29/421 R; 100/278

[58] Field of Search ..... 72/54, 63, 446, 448, 72/455, 456, 56; 29/421 R; 425/389, 394, 405 R, DIG. 19, DIG. 112; 100/214, 278, 918, 269 A

[56] References Cited

U.S. PATENT DOCUMENTS

| | | | |
|---|---|---|---|
| 2,771,850 | 11/1956 | Wheelon | 425/DIG. 19 |
| 2,854,940 | 10/1958 | Bates | 72/63 |
| 2,962,994 | 12/1960 | Whellon | 72/63 |
| 3,120,205 | 2/1964 | Pfeiffer et al. | 72/63 |
| 3,391,559 | 7/1986 | Myers . | |
| 3,550,190 | 12/1970 | Landa | 100/214 |
| 4,155,476 | 5/1979 | Lipiec et al. | 100/214 |

FOREIGN PATENT DOCUMENTS 440995 9/1985 Sweden .

*Primary Examiner*—Robert L. Spruill
*Assistant Examiner*—David B. Jones
*Attorney, Agent, or Firm*—Watson, Cole, Grindle & Watson

[57] ABSTRACT

A press plant with a forming press of the pressure cell type for enhancing the forming space of the press, especially with regard to depth, which is accomplished according to the invention in that the tray has a planar bottom plate with a detachable tray frame resting thereon, the axial loads induced by the working pressure on the short ends of the tray frame in this manner being absorbed by an annular frame or the like, whereby the forming space of the inventive press plate will not be restricted by working pressure dependent dimensioning factors.

4 Claims, 3 Drawing Figures

FORMING PRESS MAT UTILIZES TRAYS FORMED OF THIN BOTTOM PLATES AND SEPARATE ANNULAR FRAMES

BACKGROUND OF THE INVENTION

The present invention relates to a press plant with a forming press of the pressure cell type. Such press plants are generally used for manufacturing difficultly-workable sheet metal parts in small series in the aircraft industry and for manufacturing prototypes in the automobile industry.

The forming press used in the plant is of the type comprising a press stand with two opposing, force-absorbing elements defining between them a working space into which can be introduced a carrier means in the form of a tray carrying forming tools and workpiece, a press plate communicating with a pressure medium source, and a diaphragm forming together with the press plate an expansible pressure cell. The plant further comprises a transport track for the tray.

THE PRIOR ART

In conventional presses of this type, a tray consisting of short ends integrated with the bottom plate and detachable long sides is fixed in position during the working cycle by the working pressure acting evenly on both short ends of the tray so as to create in this manner an equilibrium of the forces applied thereon. This means that the connection between the bottom plate and the short ends of the tray must be dimensioned to withstand such amounts of stress, which has been made possible with known presses of the type in question by dimensioning them for working pressures of up to 150 MPa. It should be appreciated, however, that the higher the dimensioning pressure, the smaller the forming space available; the restricted depth thereof in particular constituting a limitation of the usability of the press.

The development of such press plants, however, points towards the application of continually accelerating working pressures, resulting in that the required thickness of the tray bottom plate and the necessary transition radii for the connection between the short ends and bottom plate of the tray at a dimensioning working pressure of 200 MPa will to a large extent encroach on the volume and working depth obtained in the forming space.

SUMMARY OF THE INVENTION

The invention has for its object to overcome this disadvantage by suggesting a press plant construction including a forming press of the pressure cell type so as to prevent the forming space available during forming from being restricted by working pressure dependent dimensioning factors of the tray.

According to the invention, this is accomplished with a press plant which makes use of trays that each comprise a thin bottom plate and a separate annular frame which is removably positionable on the thin bottom plate and has thin long sides and thick short ends. By setting aside the principle construction of trays for such presses that has been established since the fifties and letting instead the axial load induced by the working pressure be absorbed by a horizontal, annular frame disposed outside the press stand, there is obtained a forming space which, under prevailing working pressures, is considerably larger than that of prior art tray constructions. Furthermore, the inventive design involving a loose tray frame and a planar bottom plate affords simplified handling during operation of the plant.

These and other advantages will appear more clearly in the following detailed description of a preferred embodiment of the invention with reference to the accompanying drawings.

DETAILED DESCRIPTION OF THE PREFERRED EMBODIMENT

Figure 1:
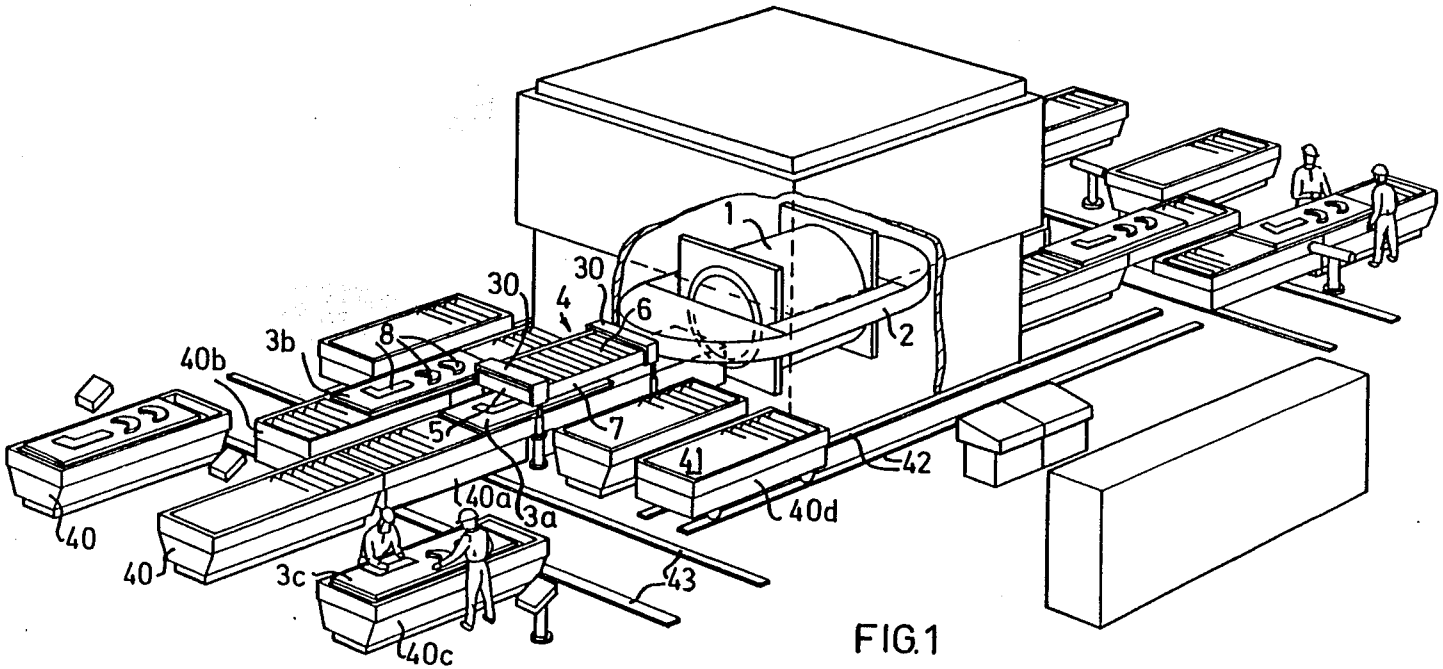
FIG. 1 is a schematic perspective view of a press plant according to the invention.

The plant of FIG. 1 comprises a press stand 1 of the type disclosed in U.S. Pat. No. 4,658,618. According to the invention, this press stand is encircled by an annular frame 2 which in the position shown in FIG. 1 is located right opposite the open short sides of the working space in the press stand. There is further arranged ahead of the open short sides, and flush with the working space bottom, a transport track for taking the tray of the plant into and out of the working space of the press.

Immediately beyond the longitudinal extension of the frame stand, a displacement device for tray frames is arranged at either short end of the press stand. FIG. 1 further illustrates a module system for the handling and transport of tray and forming tools.

Figure 2:
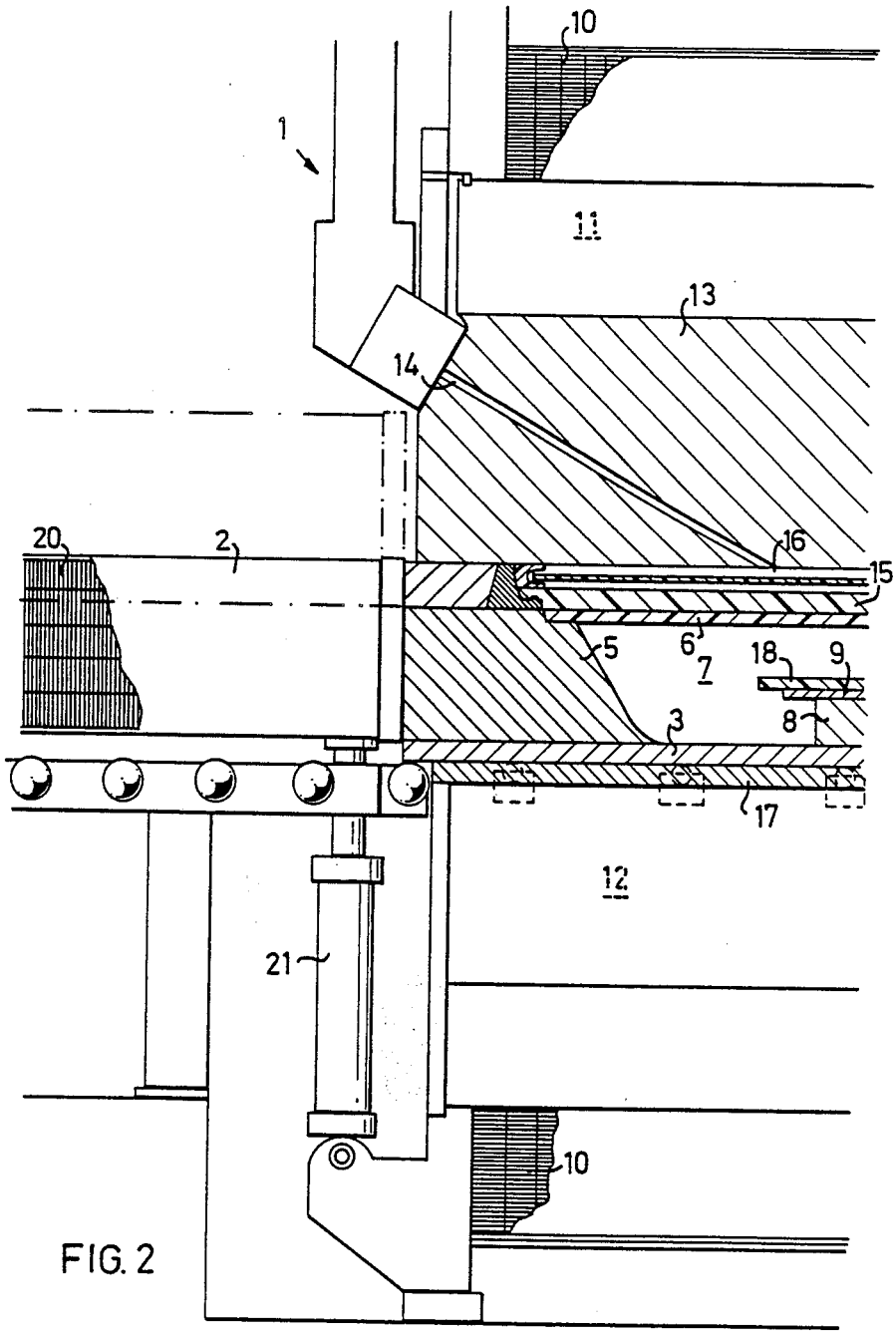
FIG. 2 is a schematic side view, partly in cross section, of a press in a plant as shown in FIG. 1.

As can be seen in FIG. 2, the press stand comprises, in a known manner, a prestress wire-wound mantle 10 accommodating yokes 11,12. A press plate 13 disposed inside the yoke 11 is in communication via channels 14 with a pressure medium source. A diaphragm 15 is placed underneath the press plate, the diaphragm and press plate together defining a closed pressure cell 16. The diaphragm is fixed in position by longitudinal side pieces having their upper sides pressed against the longitudinal periphery of the diaphragm. The lower edges of the side pieces are secured by means of wedge plates 17 extending transversely on the upper side of the yoke 12. The inventive tray is insertable into the substantially rectangular space defined by the diaphragm underside, the side pieces and the wedge plates. For this purpose, rollers or the like can be mounted at the bottom of this space, as is indicated in FIG. 2.

The tray consists of a thin, rectangular bottom plate 3 and a tray frame 4 resting on the bottom plate. A protective pad 6 of elastic material, affixed to the thick short ends 5 of the tray frame, extends across the entire length of the tray. The long sides 7 of the tray frame are joined in a suitable manner to the short ends, which may include means projecting from their undersides for coaction with recesses made in the bottom plate 3. As also appears from FIG. 2, there are arranged on the bottom plate of the tray a forming tool 8 with a sheet metal piece 9 to be worked resting thereon, as well as a protective sheathing 18 covering the workpiece. As is further shown in FIG. 2, the depth of the working space in the press stand may in principle be optimally utilized with the aid of a tray designed according to the invention.

For enabling absorption of the axial loads induced on the tray frame during pressing, a horizontal annular frame 2 is disposed opposite the short side of the working space throughout this process, the frame 2 as shown in the preferred embodiment having annular shape and, like the press stand, consisting of a prestress wire-wound mantle 20 encasing intermediate pieces located at either short end of the press stand, each piece abutting against its respective short end of the tray frame when the annular frame assumes the position shown with solid lines in FIG. 2. The annular frame is supported by hydraulic cylinders 21 while being vertically displaceable to the position shown with dash-dotted lines in FIG. 2 where the tray 3,4 can be withdrawn from the working space of the press stand 1.

Although there is obtained with the above-mentioned press stand a constructionally advantageous device for absorbing axial loads on the tray frame, other solutions are of course also conceivable. As an example, vertically displaceable cross bars resting on the short ends of the press stand could be used instead of an annular frame, as it would also be possible to make the bar pivotable instead of vertically displaceable or, alternatively, horizontally displaceable.

Figure 3:
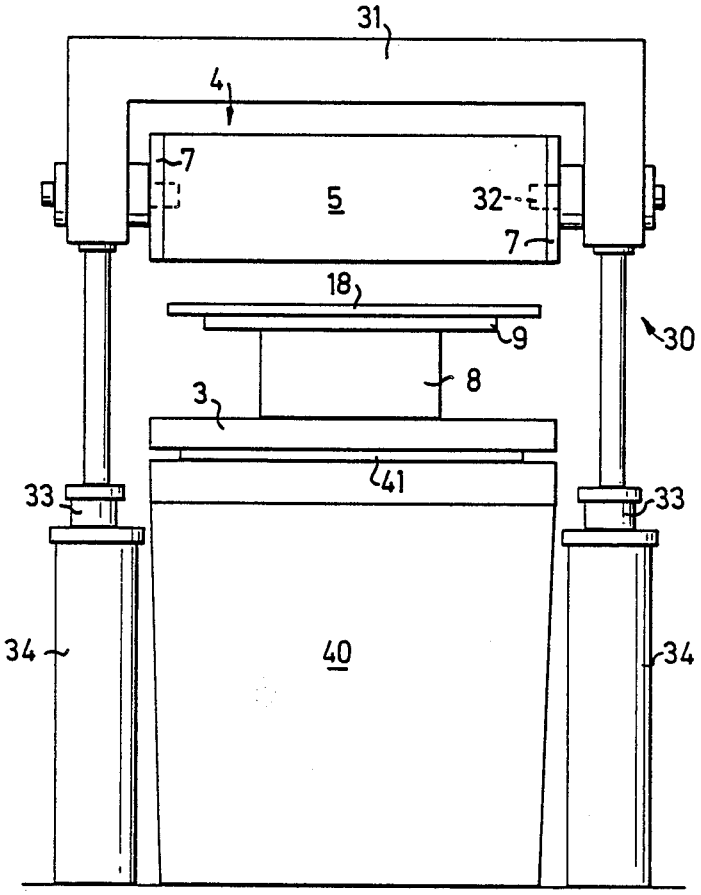
FIG. 3 is a schematic view of a displacement device for a tray frame as seen from one of its short ends.

A displacement device 30 for tray frames is arranged along the transport track outside the frame stand. As shown in FIGS. 1 and 3, this device consists of two U-shaped lifting rods 31 between which can be carried a tray frame, each rod for this purpose comprising a gripping means such as, for example, hydraulically activated plungers 32 projecting into coacting recesses made in the short ends of the tray frame. Via hydraulic cylinders 33, the lifting rods 31 are supported in vertical columns 34 for movement between a position where the tray bottom plate carrying forming tools and workpieces can be thrust in under the tray frame on the transport track, and a position where the tray frame makes abutting contact with the tray bottom plate.

Also with regard to handling, the inventive tray construction has proved superior to prior art tray constructions having short ends fixedly mounted to the bottom plate and removable long sides. By the application of forming tools, workpieces and protective sheathing on a planar tray bottom plate according to the invention, improved accessibility is gained in that the short ends will no longer restrict the freedom of movement of the operator. Moreover, there is no need for manual placement of the protective pad onto the tray frame as a separate step, as was previously required.

As already mentioned, a suitable transport system for bottom plates can be arranged in association with the press plant. The example disclosed in FIG. 1 shows a transport system consisting of box-like module units 40 having on their upper sides a conveyor belt 41 and being equipped with a drive means for the conveyor belt. These units are positioned in three sequentially following, longitudinal rows at either short end of the press stand. The units in the middle row are transversely movable along rails 43 mounted on the floor. The two outermost units in the first row run on rails 42 from one to the other end of the press stand.

During operation of the plant, the trays on each respective short end are to advantage alternately fed into the working space of the press. In the position shown in FIG. 1, the tray coming from the far short end is thus situated within the working space, whereas the nearest tray has been brought out of the press after finished pressing. As seen in FIG. 1, the bottom plate 3*a* is about to be transferred to the module unit 40*a*, and the bottom plate 3*b* to the unit 40*b*. In the next sequence, the module units are moved transversely along the rails 43 for the unit 40*b* including the bottom plate 3*b* supposedly carrying forming tools 8 and workpieces 9 covered by protective sheathings 18, to assume the position of the unit 40*a* in FIG. 1. The unit 40*a* is in turn displaced so as to come between the units 40*c* and 40*d*. By means of the conveyor belt of the unit 40*b*, the bottom plate 3*b* is then pushed in under the tray frame being elevated by the displacement device 30, and the bottom plate 3*a* carrying the ready-worked sheet metal component is transferred to the unit 40*d* simultaneously as the bottom plate 3*c* with workpiece and protective sheathing is transferred to the unit 40*a*. The tray frame 4 with its protective pad 6 is then lowered down onto the bottom plate 3*b*, whereafter the tray is ready to enter the press. After pressing has been completed for the tray undergoing treatment in the press, the nearest tray prepared as above is advanced into the press simultaneously as the tray accommodated therein is taken out and brought towards the tray displacement device arranged at the far end of the press.

The transport system described is most flexible and may of course be employed otherwise. The above-described handling procedure of the bottom plate and tray frame should serve merely as an illustrative example which is not part of the invention. With regard to economics, however, it is essential for the press to be continually driven, and therefore the transport system for the trays should be built up so as to allow for a tray carrying unprocessed workpieces to enter the press simultaneously as a tray with ready-worked components is taken out.

There is thus achieved according to the invention a press plant with a press of the pressure cell type where the forming space within the working space of the press can be utilized close to maximum. Above all, it will be possible to carry out pressing at a greater depth than what is possible with previously known presses of this type. Moreover, the inventive tray design with planar bottom plate and removable tray frame affords simplified handling since manual application of a protective pad will be superfluous, and by the increased accessibility to the planar bottom plate in comparison with bottom plates of conventional tray constructions. Also, the transport tracks can be driven at higher speeds due to the planar bottom plates having a considerably lighter weight than conventional bottom plates having integrated tray short ends and considerably thicker dimensions than the thin bottom plates according to the invention. It is furhter recognized that for identical volumes of forming space available, the press stand of the inventive press is smaller in size than those of previously known presses. Finally, the inventive tray design is superior to conventional constructions also with regard to manufacture.

What I claim is:

1. An apparatus for pressing work pieces, said apparatus comprising a forming press of a pressure cell type, said forming press including a press stand having an upper force-absorbing element, a lower force-absorbing element, a press plate having channels for a pressure medium positioned between said upper and lower force-absorbing plates, and a diaphragm positioned between said press plate and said lower force-absorbing element, said diaphragm and said lower force-absorbing element providing a parallelepipedical working space therebetween which has opposite ends that are open, a tray for carrying forming tools and work pieces into and out of said working space, said tray consisting of a thin bottom plate and a rectangular frame resting on said bottom plate, said frame having thin long sides and thick short ends, said thick short ends acting to close said open ends of said working space when said tray is located in said working space, transport means for horizontally moving said tray into and out of said working space through the open ends thereof, and load-absorbing means located outside of said press stand and movable from a first position wherein it blocks at least one of the open ends of said working space to absorb an axial load induced on the short ends of the rectangular frame of said tray when said tray is located in said working space and the diaphragm of said press stand is moved toward said lower force-absorbing element by pressure medium passing through the channels in said press plate, or to a second position wherein it allows full access to the open ends of said working space to enable said tray to be moved into or moved out of said working space.

2. An apparatus as defined in claim 1, wherein said load-absorbing means comprises a horizontal annular frame which is vertically movable between said first and second positions.

3. An apparatus as defined in claim 1, wherein the rectangular frame of said tray includes a protective pad connected between upper edges of the thick short ends thereof.

4. An apparatus as defined in claim 1, wherein one of said open ends of said working space on said press stand is an inlet end and the other is an outlet end, and wherein said transport means including a first displacement device located near said inlet end of said working space and a second displacement device located near said outlet end of said working space, said first displacement device being capable of lowering said rectangular frame onto said bottom plate to provide said tray ready for movement into said working space, and said second displacement device being capable of raising said rectangular frame away from said bottom plate after said tray has been moved out of said working space.

* * * * *

UNITED STATES PATENT AND TRADEMARK OFFICE

CERTIFICATE OF CORRECTION

PATENT NO. : 4,711,111

DATED : December 8, 1987

INVENTOR(S) : Keijo Hellgren

It is certified that error appears in the above-identified patent and that said Letters Patent is hereby corrected as shown below:

[54] IN THE TITLE OF THE INVENTION:

Change "MAT" to --THAT--

Signed and Sealed this

Tenth Day of May, 1988

*Attest:*

DONALD J. QUIGG

*Attesting Officer*

*Commissioner of Patents and Trademarks*